US005930850A

United States Patent [19]

Baker

[11] Patent Number: 5,930,850

[45] Date of Patent: Aug. 3, 1999

[54] SWIMMING POOL SKIMMING GUTTER HAVING A CLOSED GUTTER CONDUIT AND WATER-SPRAY TUBE THEREIN

[76] Inventor: William H. Baker, 50 Fairway Ridge Rd, Lake Wylie, S.C. 29710

[21] Appl. No.: 09/120,158

[22] Filed: Jul. 21, 1998

[51] Int. Cl.[6] ..... E04H 4/00

[52] U.S. Cl. ..... 4/510; 4/507

[58] Field of Search ..... 4/507, 506, 508, 4/510, 511, 512, 488, 491, 496

[56] References Cited

U.S. PATENT DOCUMENTS

| | | | |
|---|---|---|---|
| 1,797,397 | 3/1931 | Booraem et al. . | |
| 2,932,397 | 4/1960 | Ogden . | |
| 3,363,767 | 1/1968 | Ellis . | |
| 3,668,712 | 6/1972 | Baker . | |
| 3,668,713 | 6/1972 | Baker . | |
| 3,668,714 | 6/1972 | Baker . | |
| 3,815,160 | 6/1974 | Baker . | |
| 3,990,167 | 11/1976 | Whitten, Jr. | 3/510 |
| 4,050,104 | 9/1977 | Baker . | |
| 4,059,856 | 11/1977 | Patterson . | |
| 4,080,670 | 3/1978 | Van den Broek | 4/510 |
| 4,121,307 | 10/1978 | Patterson . | |
| 4,235,008 | 11/1980 | Meredith | 4/510 |

*Primary Examiner*—David J. Walczak
*Attorney, Agent, or Firm*—Kennedy Covington Lobdell & Hickman, L.L.P.

[57] ABSTRACT

A perimeter skimming gutter and retaining wall of a swimming pool comprises an elongate open first gutter conduit extending about the periphery of the swimming pool for receiving water from the swimming pool; an elongate closed second gutter conduit extending about the periphery of the swimming pool adjacent the first gutter conduit and in fluid communication with the first gutter conduit for receiving water from the first gutter conduit for water flow in a direction toward a filtration and circulation system; and a plurality of water-spray tubes disposed within the second gutter conduit and extending transversely to the water flow through the second gutter conduit. Each water-spray tube includes a plurality of jet spray openings arranged to direct a spray of water within the second gutter conduit only in the direction of water flow toward the filtration and circulation system to propel and thereby increase water flow within the second gutter conduit. A source of pressurized water is fed to the water spray tubes. The second gutter conduit has a generally rectangular cross-section along the direction of water flow and the water-spray tube extends along and is secured to an inner peripheral cross-sectional surface of the second conduit. Alternatively, the second gutter conduit has a circular cross-section or a trapezoidal cross-section and the water-spray tube extends along and is secured to the entire inner peripheral cross-sectional surface thereof. Preferably, the wall is formed from a plurality of modular units constructed off-site of the swimming pool.

20 Claims, 7 Drawing Sheets

SWIMMING POOL SKIMMING GUTTER HAVING A CLOSED GUTTER CONDUIT AND WATER-SPRAY TUBE THEREIN

BACKGROUND OF THE PRESENT INVENTION

The gutter system of a swimming pool is one of its most important components, and its design is determinative of many of the characteristics of the pool. However, what constitutes good gutter system has long been a perplexing problem in much dispute. What is recognized is that a gutter system must provide an adequate surge flow capacity, especially when the pool is filled with swimmers, and it should not flood when a large group of swimmers enters the pool. It should also provide good surge and wave quelling capacity. Its ability to cope with surges and waves produced by swimmers is quite important to the competitive qualities of the swimming pool.

A problem related to gutter design is the removal of surface dirt. Some types of gutter system are intended to provide a skimming action, but it has generally been conceded that the most efficient type of skimming action is provided by the scum gutter type of pool, and on all pools over 1,600 square feet in area, scum gutters are provided as a matter of course. In fact, in some states, surface skimmers are not permitted.

One type of swimming pool with a perimeter skimming gutter and retaining wall provides for flow of water over the top of the gutter wall into the gutter trough at all times. Such a gutter system is described in U.S. Pat. No. 2,932,397 to Ogden dated Apr. 12, 1960. Another and older design appears in U.S. Pat. No. 1,797,397 to Booraem dated Mar. 24, 1931. Such a gutter system provides an efficient skimming action under normal flow conditions, but as soon as swimmers enter the pool, or a heavy surge or wave action is encountered, the additional flow of water over the top of the gutter tends to flood the gutter, after which skimming action is lost until the water can be drained away, and in fact some of the dirt already in the gutter may be washed back.

In an attempt to alleviate such a condition, a modification of the Ogden gutter system has been proposed in U.S. Pat. No. 3,363,767 to Ellis dated Jan. 16, 1968, incorporating a plurality of skimmer openings spaced around the gutter at a lower level than the top of the gutter. In this gutter system, when the pool is not in use, the skimmer weir is opened and skimming is obtained via the openings into the gutter. When the pool is in use, the skimmer weirs are closed, but the water level is held down below the lip of the gutter, providing a certain in-pool surge capacity, and avoiding a flooded gutter condition at the time of flow surges. However, when the pool is in heavy use and there is considerable wave or surge action over the top of the gutter, surface contaminants washed into the gutter may still be washed back into the pool.

U.S. Pat. Nos. 3,668,712 and 3,668,714, issued Jun. 13, 1972 to Baker, provide perimeter skimming gutters and retaining walls for swimming pools which permit an adequate skimming action at all times and which provide an adequate surge capacity when the pool is in use without the possibility of the flooding of the gutter or of the washing of dirt in the gutter back into the pool.

This is accomplished in Baker '712 by combining a plurality of narrow, elongated, substantially horizontally disposed openings which are open at all times in the retaining wall disposed about the perimeter of the swimming pool, with the peripheral gutter conduit arranged to receive water spilling over the top of the retaining wall when the flow capacity of the elongated openings is exceeded. The elongated openings can be arranged to feed water into the main gutter conduit, or into a separate second gutter conduit keeping the two water flows completely separate and thereby retaining the dirt skimmed off the top of the pool in the second conduit and avoiding the hazard of this dirt being washed back into the pool in the unlikely event of the first gutter conduit being flooded during wave actions or surges. In this gutter system, the water level in the pool is normally maintained at the level of the skimmer openings in the gutter.

In Baker '714, the perimeter skimming gutter comprises a first gutter conduit for disposition about the perimeter of a swimming pool adapted to carry water at a level below a predetermined level of water in the swimming pool; a retaining wall on the pool-side of the first gutter conduit, over the top of which wall water may flow from the pool into the first gutter conduit; and a second gutter conduit in fluid flow connection with the first, such fluid flow connection entering the first gutter conduit at a level below the top of the retaining wall but above a predetermined maximum level in the first gutter conduit to drain off water from the first gutter conduit thereby precluding the level of water in the first gutter conduit from reaching the top of the retaining wall.

U.S. Pat. No. 3,668,713, issued Jun. 13, 1972 to Baker, provides a fluid flow and/or fluid pressure responsive gate weir for swimming pools, comprising in combination: a weir support; a fluid flow passage in the support; a gate member pivotally mounted in the support across the passage for movement between flow-open and flow-closed positions; a gate controller disposed to encounter a fluid flow through and/or fluid pressure in the passage above a predetermined minimum, and responsive to such flow and/or pressure to pivot the gate member from a flow-open towards a flow-closed position; and means arranged to retain the gate member in the flow-open position under normal conditions of fluid flow and/or fluid pressure through the weir passage and the permit pivotal movement of the gate members towards a flow-closed position under excessive fluid flow and/or fluid pressure continues. Means can also be provided to return the gate member to the flow-open position when such excessive flow and/or pressure subsides, and/or returns to normal.

U.S. Pat. No. 3,815,160, issued Jun. 11, 1974 to Baker, provides a nonflooding perimeter skimming gutter and retaining wall for swimming pools including: a first gutter conduit for disposition about the perimeter of a swimming pool and adapted to carry water at a level below a predetermined level of water in the swimming pool; a retaining wall on the pool-side of the first gutter conduit over the top of which wall a skimming flow of water may run from the pool into the first gutter conduit; a second gutter conduit within a peripheral wall below the first gutter conduit and adapted to carry water at a level above a predetermined level of water in the first gutter conduit; and a fluid flow connection between the two gutter conduits at such level and below the top of the retaining wall to allow water to flow from the first gutter conduit into the second gutter conduit whenever the water level in the first gutter conduit reaches the fluid flow connection, thereby inhibiting filling of the first gutter conduit appreciably above such level.

In the twin gutter structures provided in these patents, the two gutters are separate and of fixed dimensions. While the gutters can be interconnected at a number of locations, flow therebetween is normally not possible until one or the other reaches a predetermined overflow level. This is highly desirable in most circumstances, but on occasion a single gutter of large capacity may be preferred and in the fixed-in-place structures of the type described above, this is impossible.

In accordance with U.S. Pat. No. 4,050,104, issued Sep. 27, 1977 to Baker, a twin gutter system is provided in which the twin gutters can be kept separate or combined in one, as desired, by forming the two gutters with at least one common wall, of which at least a portion thereof can be removed. This feature can be applied in any of the twin gutter systems of U.S. Pat. Nos. 3,688,712; 3,668,713; 3,668,714; and 3,815,160, with or without a skimming function as desired. The common wall can be all or part of a side wall, an end wall, a bottom wall, or a corner wall of the gutters.

In all of these gutter systems, the open gutter conduit or gutter trough is intended to receive and carry off floating debris from the surface of the pool, as well as suspended dirt and any similar contaminants, and such material after falling into the gutter is flushed to a filter and removed to keep the gutter in proper functioning order. Gravity flow along the gutter can be relied upon for flushing but often gravity generates water flow that is too slow to provide adequate flushing and cleansing of the gutter trough.

It has therefore been proposed to supplement the cleansing of the gutter trough by gravitational water flow in various ways. For example, Ogden '397, referred to above, discloses valved jet sprays arranged to spray within in the gutter trough when cleansing of the gutter trough is desired. Patterson U.S. Pat. No. 4,059,856, issued Nov. 29, 1977, provides a swimming pool gutter including a combined conduit and a sealed filtered water inlet conduit at the bottom of the gutter conduit. The gutter is formed from two sheet metal members joined by two exposed welds to form a deep-walled gutter capable of accommodating water surges and waves without flooding and having a sealed filtered water inlet combined therewith. Mounted on and spaced along the filtered water inlet conduit are spray nozzles as shown in the embodiments of FIGS. 3 and 4. These spray nozzles communicate through the conduit wall and provide for the distribution of a fine, high pressure spray into the open gutter trough and are directed to provide a continuous flush of filtered water within the gutter trough to continuously wash dirt and debris therefrom.

Notably, in both Odgen '397 and in Patterson '856 the water spray is provided in the open gutter conduit or gutter trough for cleansing of the gutter by direct application of the jet spray within the open gutter conduit. An alternative approach to this direct application of water spray within the open gutter conduit or gutter trough is disclosed by Patterson U.S. Pat. No. 4,121,307, issued Oct. 24, 1978, which utilizes suction within the gutter trough.

Specifically, Patterson '307 provides an open gutter conduit or trough around the pool perimeter including a back wall, a bottom and an inner wall. A suction pipe extending around the perimeter of the pool at the bottom of the gutter trough and connected to the suction side of a pump for positive withdrawal of water from the gutter trough. In the embodiment shown in FIG. 2 of Patterson, the gutter trough is completely open although a grate or screen may be conveniently employed across the top to prevent possible plugging of the suction pipe holes by debris. In this gutter design, a continuous flow of water either through the skimmers or over the lip of the gutter conduit maintains a level of water in the gutter above the holes in the suction pipe to maintain a continuous and positive flow of water from the gutter conduit to the pool filter. The use of suction evacuation of water provides assurance of sufficient gutter capacity to accommodate even the greatest conditions of activity in the pool while avoiding flooding of the gutter. Further, it avoids the necessity of water traveling from remote locations via the gutter to the filter, but rather effects the removal of the water directly from the gutter from locations spaced around the pool. In operation, the water from the pool flows into the gutter continuously through the skimmer openings or over the top of the inner gutter wall in the case of surges from pool activity. In any event, the float automatically operates to provide assurance that al all times the passageways in the tube are covered with water. When so covered with water, a suction pipe withdrawing water from the tube will substantially uniformly draw water out of the gutter at all locations around the perimeter of the pool. Thus, the combination of the automatic float-controlled skimmer maintaining a proper level of water in the gutter and the suction pipe around the perimeter of the pool provides for continuous evacuation of the water from all parts of the gutter without cavitation of the pump and without gravity flow.

While the approaches taken in Odgen '397, Patterson '856, and Patterson '307 may be adequate in each perimeter skimming gutter and retaining wall disclosed therein, a need remains for still yet another efficient and cost effective approach for increasing water flow from the gutter trough to the filtration and circular system, particularly for use in the perimeter skimming gutter and retaining walls disclosed in the numerous patents to Baker discussed above.

SUMMARY OF THE PRESENT INVENTION

An object of the present invention is to increase water flow in the perimeter skimming gutter and retaining wall of a swimming pool to the filtration and circulation system of the swimming pool and, consequently, thereby improve the cleansing ability of the water flow in the open gutter conduit or gutter trough.

Yet another object is to provide a gutter system which automatically increases water flow from the gutter trough to the filtration and circulation system during periods of high pool use to thereby minimize the possibility of overflow of the gutter trough.

These and other objects of the present invention are obtained by the provision within a closed gutter conduit separate from the gutter trough of water-spray tubes for the projection of water spray along the direction of water flow through the closed gutter conduit thereby increasing the water flow to the filtration and circulation system.

Briefly, the present invention includes a perimeter skimming gutter and retaining wall of a swimming pool having an elongate open first gutter conduit forming the gutter trough extending about the periphery of the swimming pool for receiving water skimmed from the swimming pool; an elongate closed second gutter conduit extending about the periphery of the swimming pool adjacent the first gutter conduit and in fluid communication with the first gutter conduit for receiving water from the first gutter conduit for water flow in a direction toward a filtration and circulation system; and a plurality of water-spray tubes disposed within the second gutter conduit and extending transversely to the water flow through the second gutter conduit. Each water-spray tube includes a plurality of jet spray openings arranged to direct a spray of water within the second gutter conduit only in the direction of water flow toward the filtration and circulation system to propel and thereby increase water flow within the second gutter conduit. A source of pressurized water is fed to the water spray tubes.

The second closed gutter conduit includes a generally rectangular cross-section along the direction of water flow and the water-spray tube extends along and is secured to an inner peripheral cross-sectional surface of the second closed gutter conduit at various locations about the swimming pool. Alternatively, the second gutter conduit is formed with a circular cross-section or a trapezoidal cross-section and the water-spray tube extends along and is secured to the entire inner peripheral cross-sectional surface thereof at various locations about the swimming pool.

The perimeter skimming gutter and retaining wall itself can be formed in situ or constructed from a plurality of modular sections constructed off-site and transported to the swimming pool construction site. Accordingly, a preferred modular section of the perimeter skimming gutter and retaining wall in accordance with the present invention includes an elongate open first gutter conduit for receiving water from the swimming pool; an elongate closed second gutter conduit extending in a longitudinal direction for receiving water from the first gutter conduit for water flow in a direction toward a filtration and circulation system; and at least one a water-spray tube disposed within the second gutter conduit and extending transversely to the longitudinal direction of the second gutter conduit, with the water-spray tube including a plurality of jet spray openings arranged to direct a spray of water within the second gutter conduit only in the direction of the water flow to the filtration and circulation system to propel and thereby increase the water flow within said second gutter conduit. Furthermore, at least one of the modular units includes the second gutter conduit disposed in fluid communication with the first gutter conduit.

In a feature of the present invention, the modular section of the present invention further includes an elongate closed third gutter conduit that extends in the longitudinal direction for returning water from the filtration and circulation system to the swimming pool. The third gutter conduit preferably extends in vertical parallel alignment to the second gutter conduit with a wall of the third gutter conduit and a wall of the second gutter conduit together defining the retaining wall portion of the modular section. Moreover, a second wall of the third gutter conduit and a second wall of the second gutter conduit together preferably define a wall of the first open gutter conduit or gutter trough.

In other features of the present invention, the water-spray tube extends immediately adjacent an inner peripheral cross-sectional surface of the second closed gutter conduit which forms part of the top wall of the second closed gutter conduit; the plurality of jet spray openings are linearly spaced from one another along the water-spray tube; and the first open gutter conduit extends longitudinally adjacent to the second closed gutter conduit, or alternatively, the second closed gutter conduit is disposed within the first open gutter conduit.

In still yet another feature of the present invention, a second water-spray tube is identically disposed within the closed second gutter conduit and extends over the first water-spray tube in vertically spaced parallel alignment therewith. Furthermore, the first and second water-spray tubes preferably extend immediately adjacent inner peripheral cross-sectional surfaces of the second closed gutter conduit for water flow therebetween, with the inner peripheral cross-sectional surfaces forming part of the top and bottom walls of the second closed gutter conduit. In an additional feature, the jet spray openings of the first and said second water-spray tubes are arranged to project a spay that converges at a point along a longitudinal axis of the second closed gutter conduit.

BRIEF DESCRIPTION OF THE DRAWINGS

Preferred embodiments of the closed gutter conduit and water-spray tubes of the present invention are illustrated in the drawings, in which.

DETAILED DESCRIPTION OF THE PREFERRED EMBODIMENTS OF THE PRESENT INVENTION

A perimeter skimming gutter and retaining wall in accordance with the present invention includes water-spray tubes disposed within a closed gutter conduit for water flow from a gutter trough of the perimeter skimming gutter and retaining wall to a filtration and circulation system.

Figure 5:
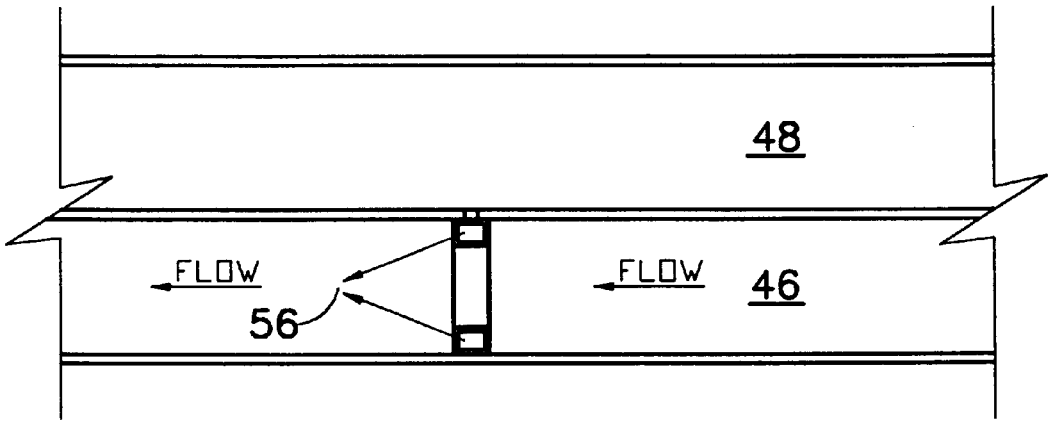
FIG. 5 is a cross-sectional view along the line 5—5 of FIG. 1.
Figure 6:
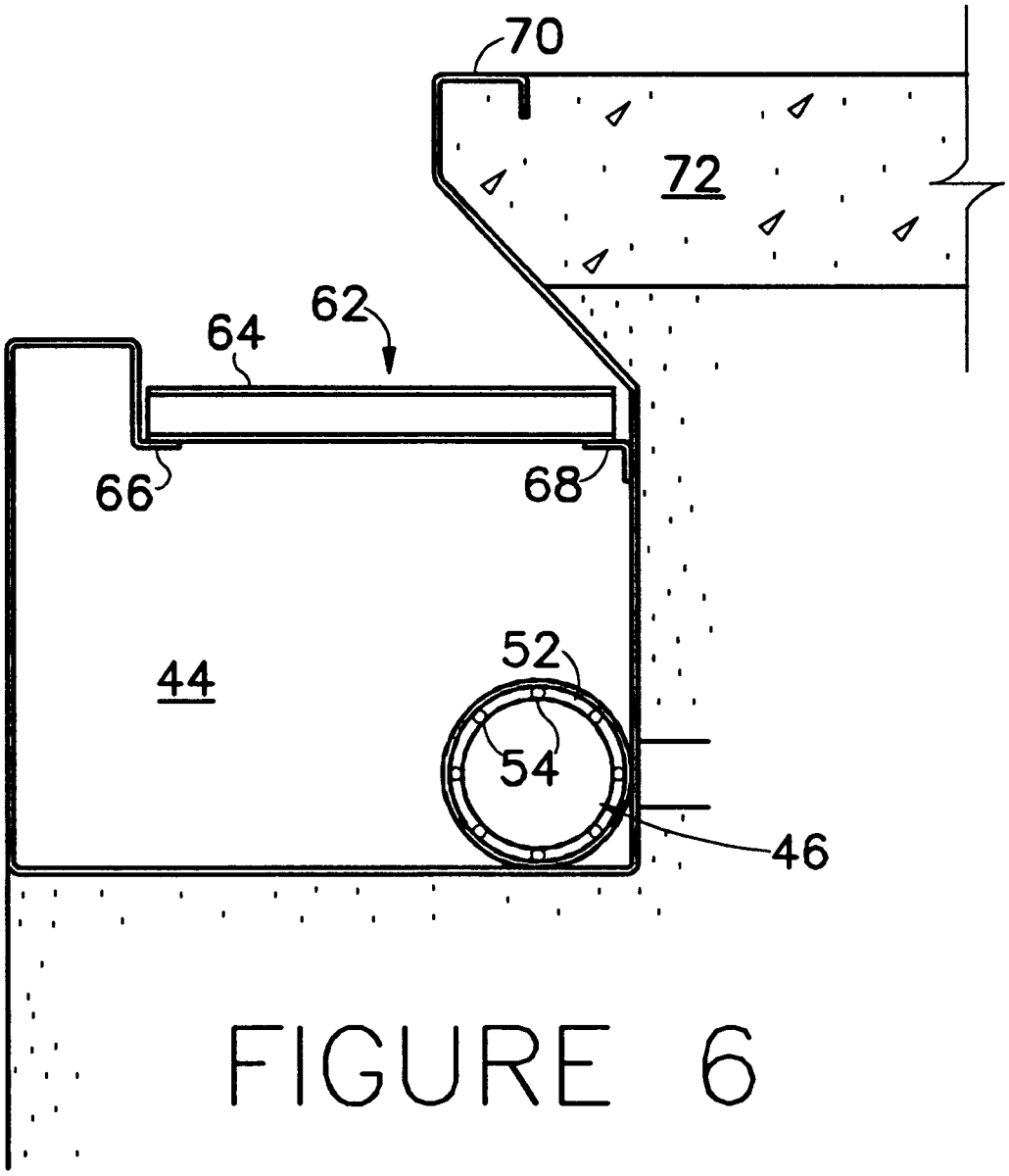
FIG. 6 is an cross-sectional view of a second modular section of a perimeter skimming gutter and retaining wall in accordance with the present invention.
Figure 7:
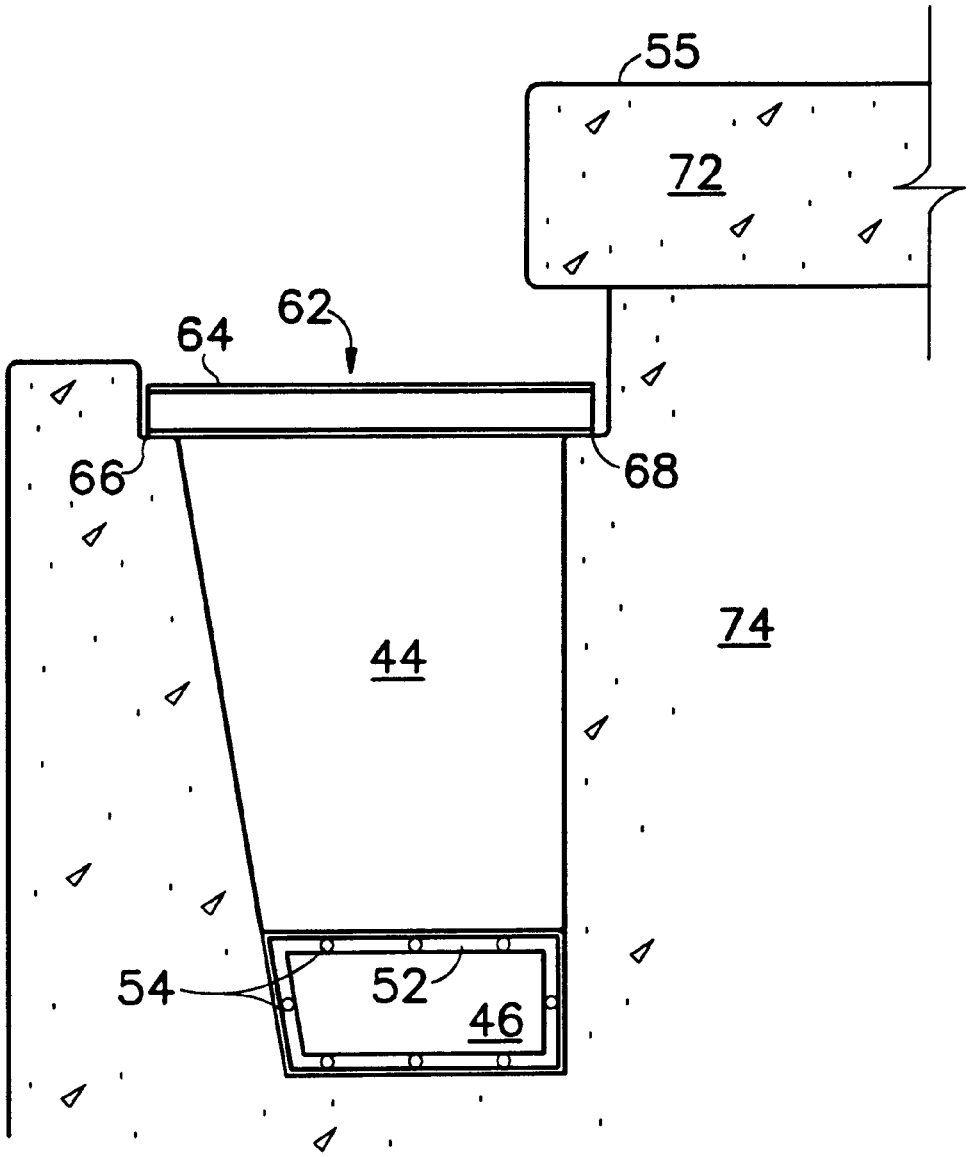
FIG. 7 is a cross-sectional view along the line 7—7 of the perimeter skimming gutter and retaining wall of FIG. 8.
Figure 8:
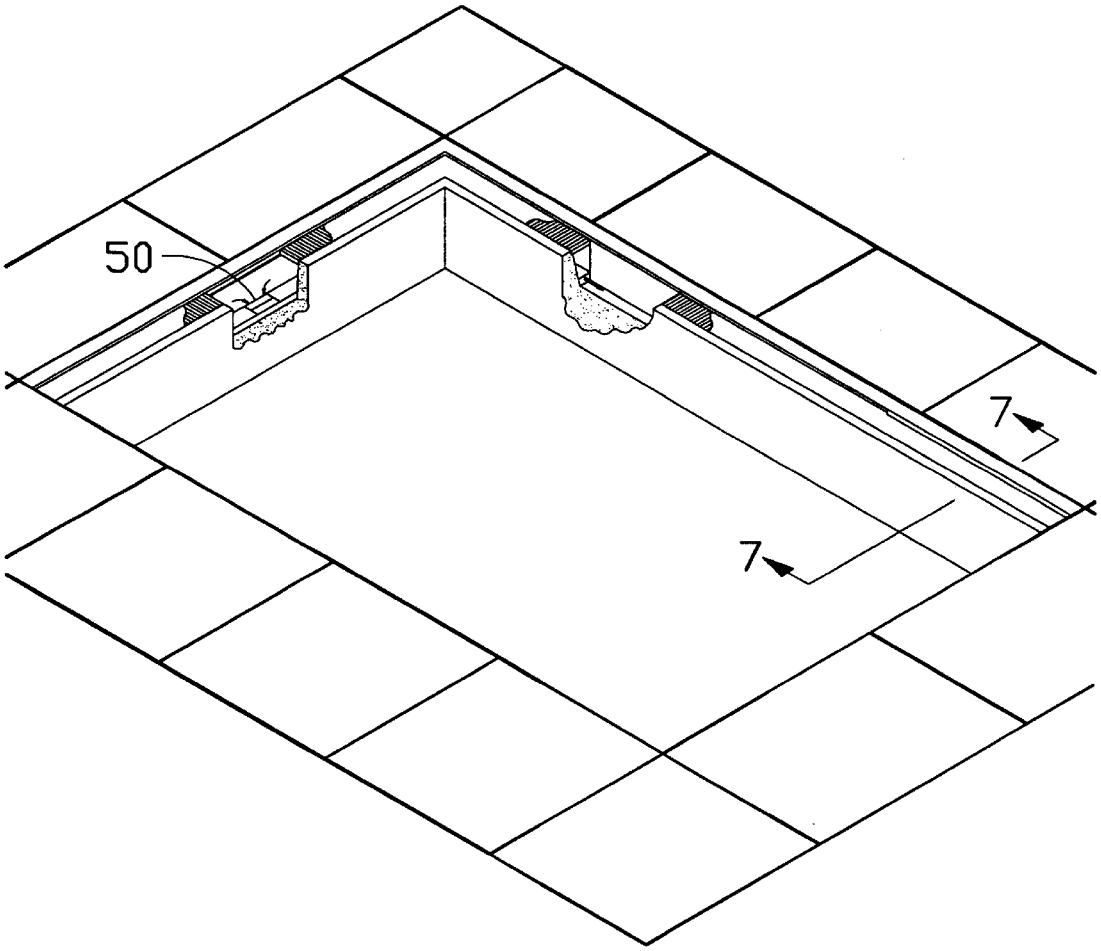
FIG. 8 is a perspective view, partially broken away, of a perimeter skimming gutter and retaining wall in accordance with the present invention.

The perimeter skimming gutter and retaining wall commonly is constructed from a number of modular sections and cross-sectional views of such modular sections are shown in FIGS. 1–6; however, perimeter skimming gutter and retaining walls of the present invention also can be constructed in situ without the use of modular sections, and such a perimeter skimming gutter and retaining wall is shown in FIG. 8, a cross-sectional view of which also is shown in FIG. 7. Consequently, the use of modular sections to form a perimeter skimming gutter and retaining wall of the present invention is not considered a necessary feature of the present invention, and accordingly, the configurations of the water-spray tubes and closed gutter conduit of the modular sections of FIGS. 1–5 applies to any perimeter skimming gutter and retaining wall of the present invention regardless of whether formed from modular sections, and the configuration of the water-spray tubes and closed gutter conduit of the perimeter skimming gutter and retaining wall of FIGS. 7–8 equally apply to any perimeter skimming gutter and retaining wall of the present invention.

With particular regard to the modular section 10 and the configuration of the water-spray tube and the closed gutter conduit thereof shown in FIGS. 1–5, the modular section 10 includes a first inverted U-shaped unit 14 comprising a stainless steel sheet shaped to form standing sides 16,18 and a top 20 corresponding to the top of the retaining wall 22. Each modular section 10 also includes a second upright U-shaped unit 24 comprising a stainless steel sheet shaped to form standing sides 26,28 and a bottom 30. The sides 18,26 cooperate to form a top portion of a side 32 of the retaining wall 22 which faces the pool, and the sides 16,28 cooperate to form a side 34 of the retaining wall 20 facing away from the pool. Modular section 10 further includes a coping 36 comprising a stainless steel sheet shaped to form an outer wall 38 and bottom 40 and is backed by concrete (not shown with regard to modular section 10) that is cast in place during construction of the pool.

The two U-shaped units 14,24 of modular section 10 are joined together by welding, soldering or brazing to opposite sides of a separator plate 42 at the butt end of the standing sides 16,18,26,28. Moreover, three welds, solders or brazings will complete the joint between the ends of sides 16,28 and plate 42; the joint between the ends of sides 18,26 and plate 42; and the joint between bottom 40 and the corner formed by side 28 and bottom 30, thus greatly facilitating assembly of the modular section 10 either at the construction site or at a distant manufacturing site.

When the three stainless steel sheets are shaped and assembled together the outer wall 38, bottom 40, and wall 34 cooperate to form an open first gutter conduit or gutter trough 44; the second U-shaped unit 24 and separator plate 42 cooperate to form a second closed gutter conduit 46 for the transport of water from the pool to a filtration and circulation system (not shown) and, specifically, from the gutter trough 44 to the filtration and circulation system; and the inverted U-shaped unit 14 and separator plate 42 cooperate to form a closed third gutter conduit 48 which returns clean water from the filtration and circulation system to the pool. The connection between the closed gutter conduit and the filtration and circulation system, as well as the filtration and circulation system itself, are conventional, are not considered a feature of the present invention, and, consequently, are not shown in the drawings.

Figure 1:
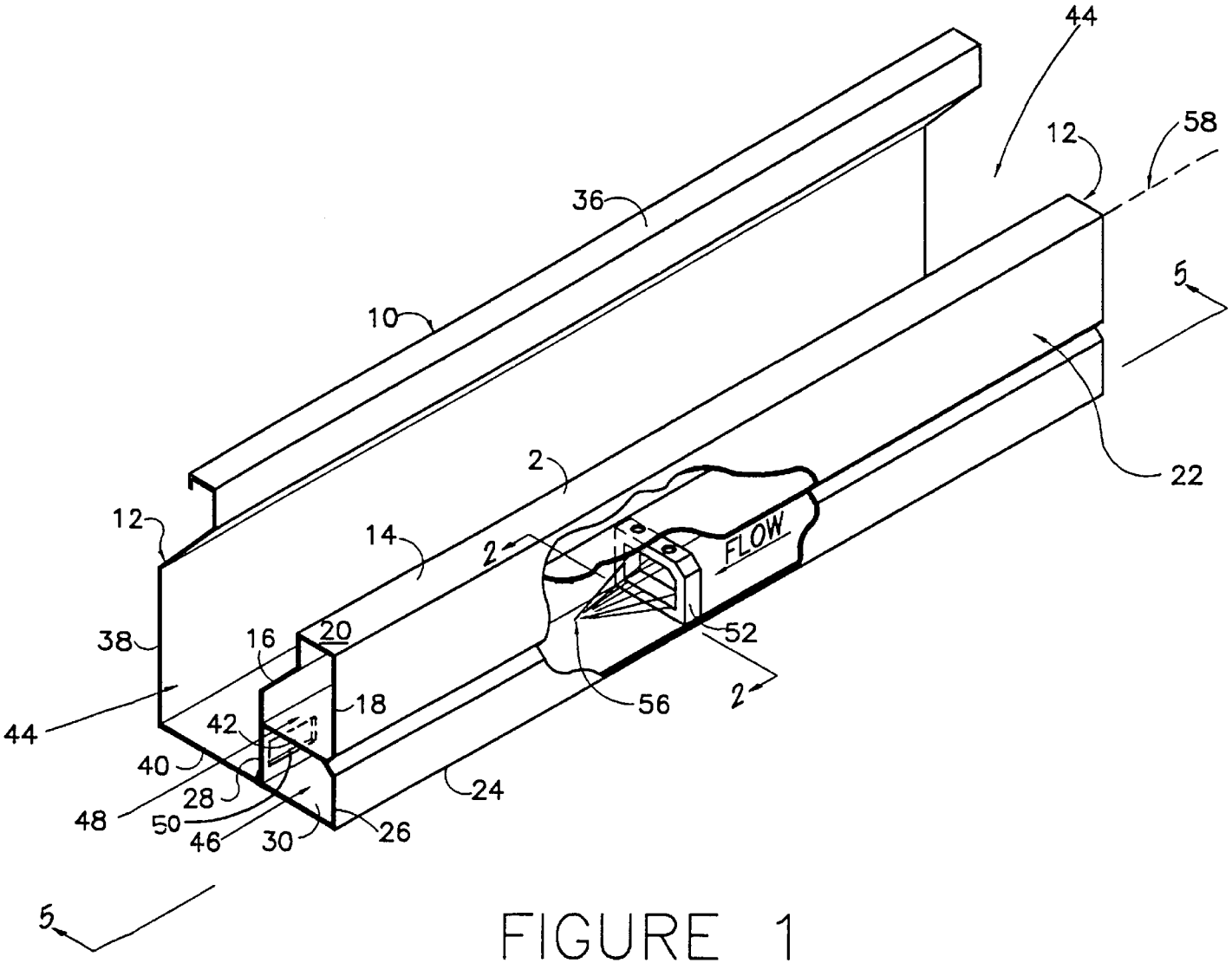
FIG. 1 is a perspective view of a modular section of a perimeter skimming gutter and retaining wall in accordance with the present invention.

In order that water may flow through the closed second gutter conduit 46 from the gutter trough 44 to the filtration and circulation system, a fluid connection 50 must be provided therebetween whereby the closed second gutter conduit 46 is disposed in fluid communication with the gutter trough 44 thereof. A fluid connection 50 is shown in FIG. 8 formed in a floor of the gutter trough 44 with regard to a perimeter skimming gutter and retaining wall having the cross-sectional view of FIG. 7, but this fluid connection 50 can be formed equally as well in the side 28 of a modular section 10 as shown in FIG. 1. Furthermore, if one or more fluid connections is disposed in a side wall of a modular section 10, then the height of the fluid connections with respect to the bottom 40 of the gutter trough 44 may be adjusted thereby permitting adjustment of the water level in the gutter trough 44. Furthermore, the fluid connections can be of any desired size and shape opening that provide a sufficient drain action and are typically elongated and substantially horizontal. Each fluid connection is sufficiently narrow, however, in order to prevent surges and waves received by the gutter trough 44 from entering the closed second gutter conduit 46.

Figure 2:
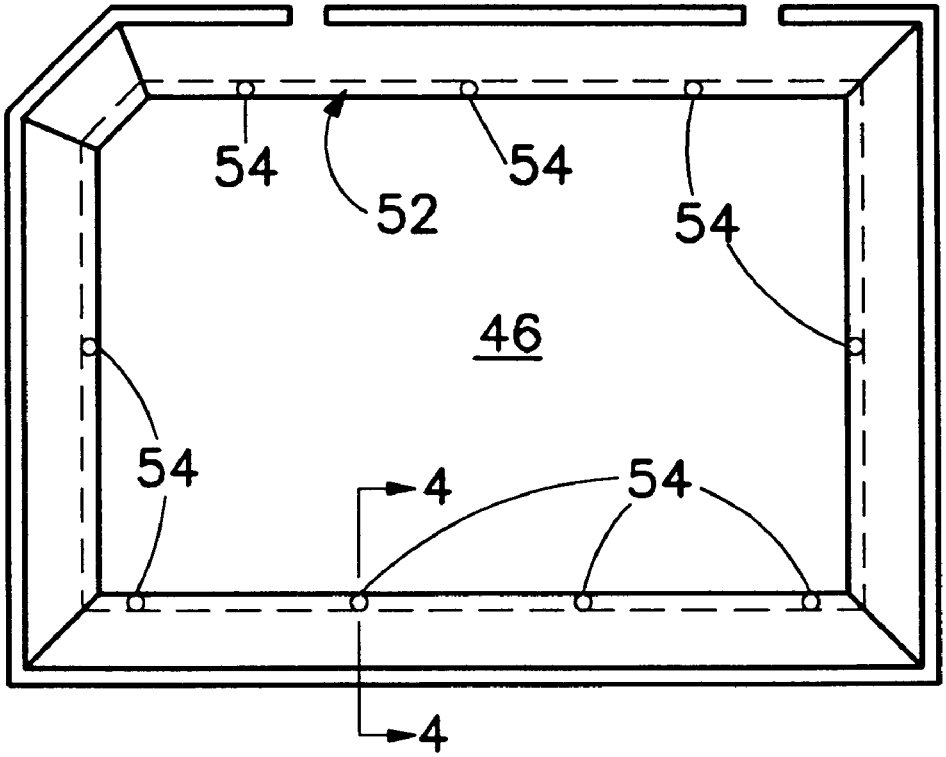
FIG. 2 is a cross-sectional view along the line 2—2 of FIG. 1.

As shown in FIGS. 1 and 2, at least one water-spray tube 52 having a plurality of jet spray openings 54 formed therein is secured to the inner peripheral surface of the closed second gutter conduit 46 of the modular section 10 by welding, soldering or brazing. Moreover, the water-spray tube 52 extends completely about the inner peripheral surface of the closed second gutter conduit 46 to form a water flow passage therethrough. Furthermore, the water-spray tube 52 is preferably provided at discrete locations along the perimeter skimming gutter and retaining wall and, in particular, the size and shape of the pool, and thus the length of the skimming gutter and retaining wall along each side as well as the cross-sectional shape and dimensions of the first and second gutter conduits 44,46, will determine how many water-spray tubes 52 are required along each side of the pool to maintain the desired water flow within the second gutter conduit 46. For a rectangular, residential-size pool, a single water-spray spray tube 52 usually suffices on each side of the pool in the case of square or rectangular or other polygonal shapes, while irregular or circular or elliptical shapes require trial and error determination.

Figure 3:
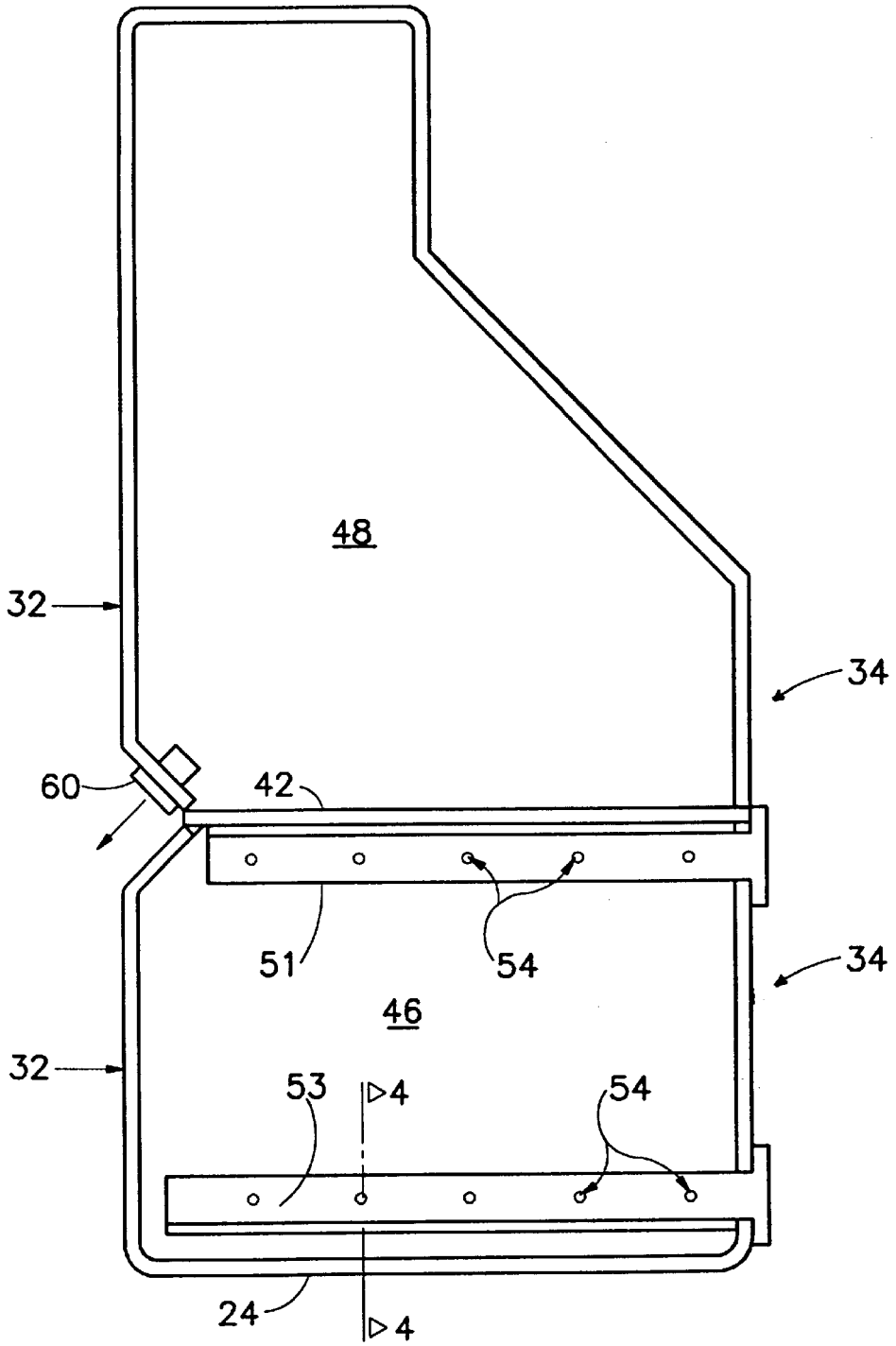
FIG. 3 is an alternative cross-sectional view along the line 2—2 of FIG. 1.

In an alternative water-spray tube arrangement shown in FIG. 3, two identical water-spray tubes 51,53 are arranged one above the other in vertically spaced parallel relation at discrete locations around the swimming pool. Water-spray tube 51 is disposed adjacent and attached to the separator plate 42 forming the top of the closed second gutter conduit 46 and the second water-spray tube 53 is disposed adjacent and attached to the bottom of the closed second gutter conduit 46.

Figure 4:
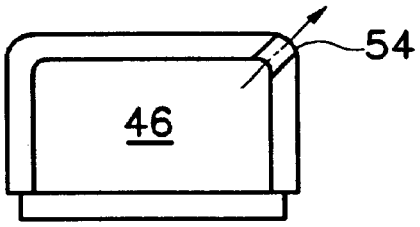
FIG. 4 is a cross-sectional view along the line 4—4 of FIG. 2.

Each jet spray openings 54 of the water-spray tube of the present invention, regardless of the water-spray tube arrangement, is arranged to provide a spray 56 in the direction of water flow through the second closed gutter conduit 46 to thereby propel and increase the water flow therethrough. Moreover, in an optional feature of the present invention each jet spray opening 52 is arranged at an angle to the central longitudinal axis of the closed second gutter conduit 46 to project a spray 56 of water to converge at a point at or near the cross-sectional center thereof in the direction of water flow through the closed second gutter conduit 46 as shown in FIGS. 1, 4, and 5.

Preferably a supply tube (not shown) is disposed in fluid communication with the water-spray tubes 51,52,53 and supplies water under sufficient pressure from the filtration and circulation system, or from another source of pressurized water including additional pumps if required, to each water-spray tubes 51,52,53 for the creation of water spray 56 within the closed second gutter conduit 56 through the jet spray openings 54. Moreover, any other conventional methods for supplying the pressurized water to each water-spray tube 52 may be used. Furthermore, water from the third gutter conduit 48 can be used in the spray tubes 52, for example, as shown in FIG. 1 where two openings are formed in the top of spray tube 52 and separator plate 42.

In operation, FIG. 1 shows the normal water level of a pool at 58 with the limiting level being defined by the top 20 of the retaining wall which provides the skimming action when the pool water reaches this level, as for example, when swimmers are in the pool. Water entering the gutter trough 44 over the top 20 then enters the closed second gutter conduit 46 via one or more fluid connections 50 and the water received in the closed second gutter conduit 46 from the gutter trough 44 is then propelled both by gravity and by the water spray 56 within the closed second gutter conduit 46 towards the connection between the second closed gutter conduit 46 and the inlet to the water filtration and circulation system. The water is then filtered and circulated back to the pool by way of the third closed gutter conduit 48 to enter the pool via water openings 60 in the third closed gutter conduit 48 as shown in FIG. 3.

In the modular section of FIG. 6 the open first gutter conduit 44 is formed of stainless steel sheet shaped as a U-trough, with an open top 62 covered by a grating 64 of stainless steel and/or PVC, supported on flanges 66,68, and the sheet terminates in the pool coping 70. The coping 70 is backed by concrete 72, cast in place during construction of the pool, and defines the outer top wall of the pool. Furthermore, no filtered water inlet feed conduit is provided in the perimeter skimming gutter and retaining wall as discussed above, the filtered water being returned to the pool via an alternate route. The closed second gutter conduit 46 which is circular in cross-section is disposed within and attached to the gutter trough 44, and the second closed gutter conduit 46 includes a spray tube 52 disposed about the inner peripheral cross-sectional surface thereof for defining water flow passage therethrough. Moreover, the spray tube 52 is in fluid communication with a supply of pressurized water and includes a plurality of water jet openings 54 arranged to provide a water spray 56 within the closed second conduit 46 towards the filtration and circulation system, as in every perimeter skimming gutter and retaining wall of the present invention.

FIG. 7 shows a cross-section of a perimeter skimming gutter and retaining wall of the present invention which is not formed from modular sections wherein the gutter trough 44 is defined by concrete 74 that is cast in place during construction of the pool. The second closed gutter conduit 46 is trapezoidal in cross-section, includes a spray tube 52 that extends completely about the inner peripheral cross-sectional surface thereof, and extends entirely over and covers the bottom of the gutter trough 44.

As is apparent from the drawings, the water-spray tube can be configured to extend in any configuration including square, circular, polygonal, or rectangular. A rectangular or square tube is preferred because it can be fitted more easily within common gutter conduits used in the industry. Furthermore, in a feature of the present invention as shown in FIGS. 3, 6, and 7, each water spray tube extends around the entire inner peripheral cross-sectional surface of the closed second gutter conduit and closely abuts and is attached thereto in order to define an open passage for water flow therethrough. Furthermore, if no obstruction of water flow is desired, the water-spray tube can be recessed into the inside wall of the closed second gutter conduit (not shown). Alternatively, the water-spray tube may be spaced from the wall so as to define an annular passage permitting water flow both through and around the water-spray tube and eliminating a dead-flow corner between the water-spray tube and the closed second conduit wall (also not shown).

As now may or may not be recognized by one skilled in the art, the increased water flow within the closed second gutter conduit creates a pressure effect arising from the pressure differential between the pressure ahead of the spray and the pressure behind the spray, the latter being lower, with this pressure differential tending to create a suction effect upstream of the spray that also increases flow. This suction effect moreover is applied at the fluid connection between the closed second gutter conduit and the first open gutter conduit or gutter trough, thereby increasing water flow in the gutter trough itself.

As a result of these effects, water flow can be increased by 50% or even more, with the maximum increase obtained when the water level in the closed second gutter conduit is above the level of the water spray whereby the water spray is directed against water and not through air, and especially when the second closed gutter conduit is completely filled with water. Furthermore, the higher the pressure head in the second closed gutter conduit, the greater the increase in flow.

It will therefore be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to preferred embodiments, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

Accordingly, the perimeter skimming gutter and retaining walls can be made from many different and conventional metals, such as galvanized iron and steel, and aluminum and anodized aluminum. Whatever the metallic material, its surface should be treated so as to render it corrosion-resistant, as by plating, galvanizing, anodizing, porcelain-enamel coating, or painting. It is also possible to form the perimeter gutter of plastic material, either in whole or in part. There are plastics now available which are sufficiently strong to withstand the wear and tear of a modern day perimeter gutter skimming and retaining wall, including, for example, acrylonitrile-butadiene-styrene resin, polycarbonate resin, polytetrafluoroethylene, polyvinyl chloride, polyvinylidene chloride, polyesters, polypropylene, polyamides, and synthetic rubbers such as polyisoprene, polybutadiene, butadiene-styrene copolymers, and butadiene-isoprene copolymers.

The common construction is from a sheet or several sheets of metallic or plastic material, which are formed into the desired configuration. It is usually preferred that the coping portion at the top rear of the perimeter gutter extend at least partially, and preferably wholly, across an open gutter trough, so as to prevent people from stepping or falling into the gutter. Such can also be prevented by covering the gutter with a grating or grid of metal or plastic. Furthermore, the use of modular sections, such as are shown in the drawings, is preferred because modular sections permit mass production of the gutter system at a point remote from the swimming pool, with easy and inexpensive transportation from that point to swimming pool construction sites anywhere in the world. The modular sections can then be assembled on-site to form any type of configuration of swimming pool. The modular sections can be made in straight sections for rectangular or other straight-sided pool shapes, while curved sections can be made for pear-shaped, elliptical, circular or other round-sided pool configurations. The modular sections can be fitted together by welding, soldering or brazing, in the case of metal sections; by bonding, using various types of adhesives, in the case of metal or plastic units; or by heat-sealing, ultrasonic welding, or heat-bonding in the case of thermoplastic plastic units. Plastic units which are not fully heat-cured can be bonded and then cured in situ to form a permanent bond on site in the course of construction of the pool.

While preferred, the perimeter gutter system of the invention need not be used completely around the pool perimeter, but only as desired. The most uniform skimming action and gutter action is of course obtained when the entire perimeter of the pool is provided with such a gutter. While construction of the gutter in the form of modular sections has been described, it will also be appreciated that the gutter system can be formed on-site in the configurations shown using concrete or plastic material, and can form an integral part of the pool wall, by casting or pouring into suitable frames, so that the material can harden and set in the desired pool shape. The construction of the gutter system is sufficiently simple so that this type of technique can be employed with good results. Since this requires more hand-work, however, and is therefore a more costly method of construction, it would not usually be preferred, particularly in the case of large pools, where construction costs may be too high to permit the luxury of a handmade gutter system on the pool site. The gutter system can also be made from bricks or tiles, which are built up in the desired configuration. These can be the usual type of material, preferably with a ceramic facing, so that it is leakproof, with the tiles being bonded together with water-resistant adhesive or cement.

Finally, the pool-side retaining walls represented in FIGS. 1–5 provide two separate closed gutter conduits, of which either can be used for the filtered water inlet feed or the water flow to the filtration and circulation system. Thus, while in the embodiments shown in the drawings the upper gutter conduit is used as a filtered water feed conduit and the lower gutter conduit is used for water flow to the filtration and circulation system, the upper conduit can be used for water flow to the filtration and circulation system and the lower conduit as the filtered water feed conduit. Moreover, if more than two conduits are desired, additional conduits can be defined by introducing additional separator walls and intermediate H-wall sections.

What is claimed is:

1. A modular section used to construct a perimeter skimming gutter and retaining wall of a swimming pool, comprising:

an elongate open first gutter conduit for receiving water from the swimming pool;

an elongate closed second gutter conduit extending in a longitudinal direction adjacent said open first gutter conduit for receiving water from said first gutter conduit for water flow in a direction toward a filtration and circulation system; and a water-spray tube disposed within said closed second gutter conduit and extending transversely to the longitudinal direction of said closed second gutter conduit, said water-spray tube including a plurality of jet spray openings arranged to direct a spray of water within said closed second gutter conduit only in the direction of the water flow to the filtration and circulation system to propel and thereby increase the water flow within said closed second gutter conduit.

2. A modular section according to claim 1, wherein said water-spray tube extends immediately adjacent an inner peripheral surface of said second gutter conduit.

3. A modular section of a perimeter skimming gutter and retaining wall of a swimming pool according to claim 2, wherein said inner peripheral surface is part of the top wall of said second gutter conduit.

4. A modular section according to claim 1, wherein said plurality of jet spray openings are linearly spaced from one another along said water-spray tube.

5. A modular section according to claim 1, wherein said second gutter conduit has a generally rectangular cross-section along its longitudinal length and said water-spray tube extends along and is secured to an inner peripheral cross-sectional surface of said second conduit.

6. A modular section according to claim 1, wherein said second gutter conduit has a circular cross-section along its longitudinal length and said water-spray tube extends along and is secured to the entire inner peripheral cross-sectional surface of said second conduit.

7. A modular section according to claim 1, wherein said second gutter conduit has a trapezoidal cross-section along its longitudinal length and said water-spray tube extends along and is secured to the entire inner peripheral cross-sectional surface of said second conduit.

8. A modular section according to claim 1, wherein said second gutter conduit is disposed in fluid communication with said first gutter conduit.

9. A modular section according to claim 1, wherein said second gutter conduit forms part of a side wall of said first gutter conduit.

10. A modular section according to claim 1, wherein said second gutter conduit is disposed within said first gutter conduit.

11. A modular section according to claim 1, further including a second water-spray tube also disposed within said second gutter conduit and extending transversely to the longitudinal direction of said second gutter conduit, said second water-spray tube also including a plurality of jet spray openings arranged to direct a spray of water within said second gutter conduit in the direction of the water flow to further propel and thereby further increase the water flow within said second gutter conduit to the filtration and circulation system.

12. A modular section according to claim 11, wherein said first water-spray tube extends over said second water-spray tube in vertically spaced parallel alignment therewith.

13. A modular section according to claim 12, wherein said first and said second water-spray tubes extend immediately adjacent inner peripheral surfaces of said second gutter conduit for water flow therebetween, said inner peripheral surfaces being part of the top and bottom walls of the second gutter conduit.

14. A modular section of according to claim 11, wherein said jet spray openings of said first and said second water-spray tubes are arranged to project a spay that converges at a point along a longitudinal axis of said second gutter conduit.

15. A modular section according to claim 1, further including an elongate closed third gutter conduit extending in the longitudinal direction for returning water from the filtration and circulation system to the swimming pool, said third gutter conduit extending in vertical parallel alignment to said second gutter conduit; wherein a wall of said third gutter conduit and a wall of said second gutter conduit together define the retaining wall of the swimming pool, and a second wall of said third gutter conduit and a second wall of said second gutter conduit together define a wall of said first gutter conduit.

16. A perimeter skimming gutter and retaining wall of a swimming pool for transporting water from the swimming pool to a filtration and circulation system, comprising:

an elongate open first gutter conduit extending about the periphery of the swimming pool for receiving water from the swimming pool;

an elongate closed second gutter conduit extending about the periphery of the swimming pool in fluid communication with said first gutter conduit for receiving water from said first gutter conduit for water flow in a direction toward a filtration and circulation system; and a plurality of water-spray tubes disposed within said second gutter conduit and extending transversely to the water flow through said second gutter conduit, each said water-spray tube including a plurality of jet spray openings arranged to direct a spray of water within said second gutter conduit only in the direction of water flow toward the filtration and circulation system to propel and thereby increase water flow within said second gutter conduit.

17. A perimeter skimming gutter and retaining wall according to claim 16, further including a closed third gutter conduit extending about the periphery of said swimming pool for returning water from the filtration and circulation system to the swimming pool, said third gutter conduit extending in vertical parallel alignment to said second gutter conduit; wherein a wall of said third gutter conduit and a wall of said second gutter conduit define the retaining wall of the swimming pool, and wherein a second wall of said third gutter conduit and a second wall of said second gutter conduit define a wall of said first gutter conduit.

18. A perimeter skimming gutter and retaining wall according to claim 16, wherein said second gutter conduit has a generally rectangular cross-section along the direction of water flow and said water-spray tubes extend along and are secured to an inner peripheral cross-sectional surface of said second conduit.

19. A perimeter skimming gutter and retaining wall according to claim 16, wherein said second gutter conduit has a circular cross-section along the direction of water flow and said water-spray tubes extend along and are secured to the entire inner peripheral cross-sectional surface of said second conduit.

20. A perimeter skimming gutter and retaining wall according to claim 16, wherein said second gutter conduit has a trapezoidal cross-section along the direction of water flow and said water-spray tubes extend along and are secured to the entire inner peripheral cross-sectional surface of said second conduit.

* * * * *